US007556126B2

(12) United States Patent
Wang

(10) Patent No.: US 7,556,126 B2
(45) Date of Patent: Jul. 7, 2009

(54) ELEVATOR ESCAPE ARRANGEMENT

(76) Inventor: Chiu Nan Wang, No. 50, Alley 97, Lane 354, San Her Rd., Feng Yuan, Taichung Hsien (TW)

( * ) Notice: Subject to any disclaimer, the term of this patent is extended or adjusted under 35 U.S.C. 154(b) by 378 days.

(21) Appl. No.: 11/514,051

(22) Filed: Aug. 31, 2006

(65) Prior Publication Data

US 2008/0078627 A1 Apr. 3, 2008

(51) Int. Cl.
*B66B 13/14* (2006.01)
*B66B 11/08* (2006.01)
*B66B 5/16* (2006.01)

(52) U.S. Cl. ..... 187/314; 187/263; 187/377

(58) Field of Classification Search ..... 187/263, 187/306, 314, 377
See application file for complete search history.

(56) References Cited

U.S. PATENT DOCUMENTS 5,228,364 A * 7/1993 Casas ..... 81/485
5,680,911 A * 10/1997 Wang ..... 187/263
5,713,433 A * 2/1998 Wang ..... 187/263
5,878,845 A * 3/1999 Wang ..... 187/272
5,890,565 A * 4/1999 Wang ..... 187/263
5,906,252 A * 5/1999 Wang ..... 187/263
6,116,380 A * 9/2000 Wang ..... 187/263
6,179,090 B1 * 1/2001 Casas ..... 187/377
6,464,043 B2 * 10/2002 Wang ..... 187/314
6,516,921 B1 * 2/2003 Wang ..... 187/263
6,557,670 B2 * 5/2003 Wang ..... 187/290
6,739,431 B1 * 5/2004 Wang ..... 187/306
RE38,835 E * 10/2005 Sevilleja et al. ..... 187/350
6,966,409 B2 * 11/2005 Wang ..... 187/290
7,032,714 B2 * 4/2006 Wang ..... 187/311
7,316,297 B2 * 1/2008 Wang ..... 187/313
7,392,885 B2 * 7/2008 Wang ..... 187/263

* cited by examiner

*Primary Examiner*—Peter M Cuomo
*Assistant Examiner*—Eric Pico
(74) *Attorney, Agent, or Firm*—Pro-Techtor Int'l Services

(57) ABSTRACT

An elevator escape arrangement includes a hinged window on a car; an escape rope passed by the window; a spring biased linking mechanism interconnected the window and a door; and a drive assembly including a first shaft, a detent block on the first shaft and between two brake bars, a cam-like member engaged with a drive sheave, a pulley on the first shaft with the escape rope run, a first gear on the first shaft, a second gear meshed with the first gear, and a second shaft passed through the second gear and the cam-like member. In case of emergency with the car stuck between two floors, the car and a counterweight balanced, and the brake activated, opening the window will cause the linking mechanism to lock the door, pulling the escape rope will unbalance and move the car, and closing the window will unlock the door for escape therethrough.

13 Claims, 15 Drawing Sheets

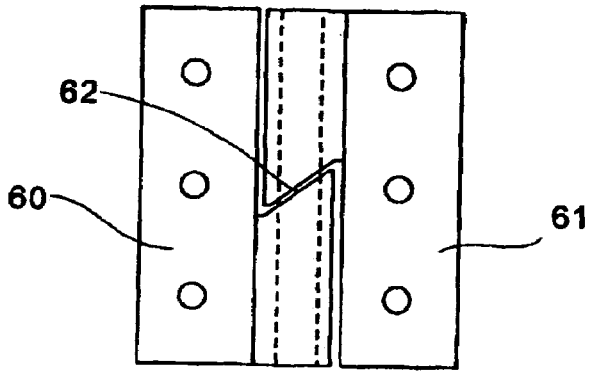
FIG, 5
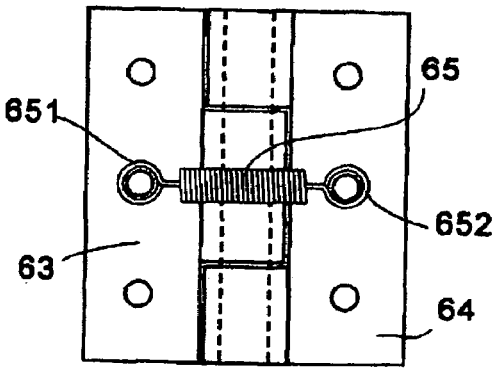
FIG, 6
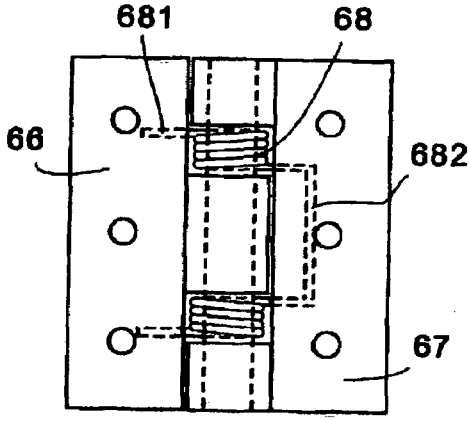
FIG, 7

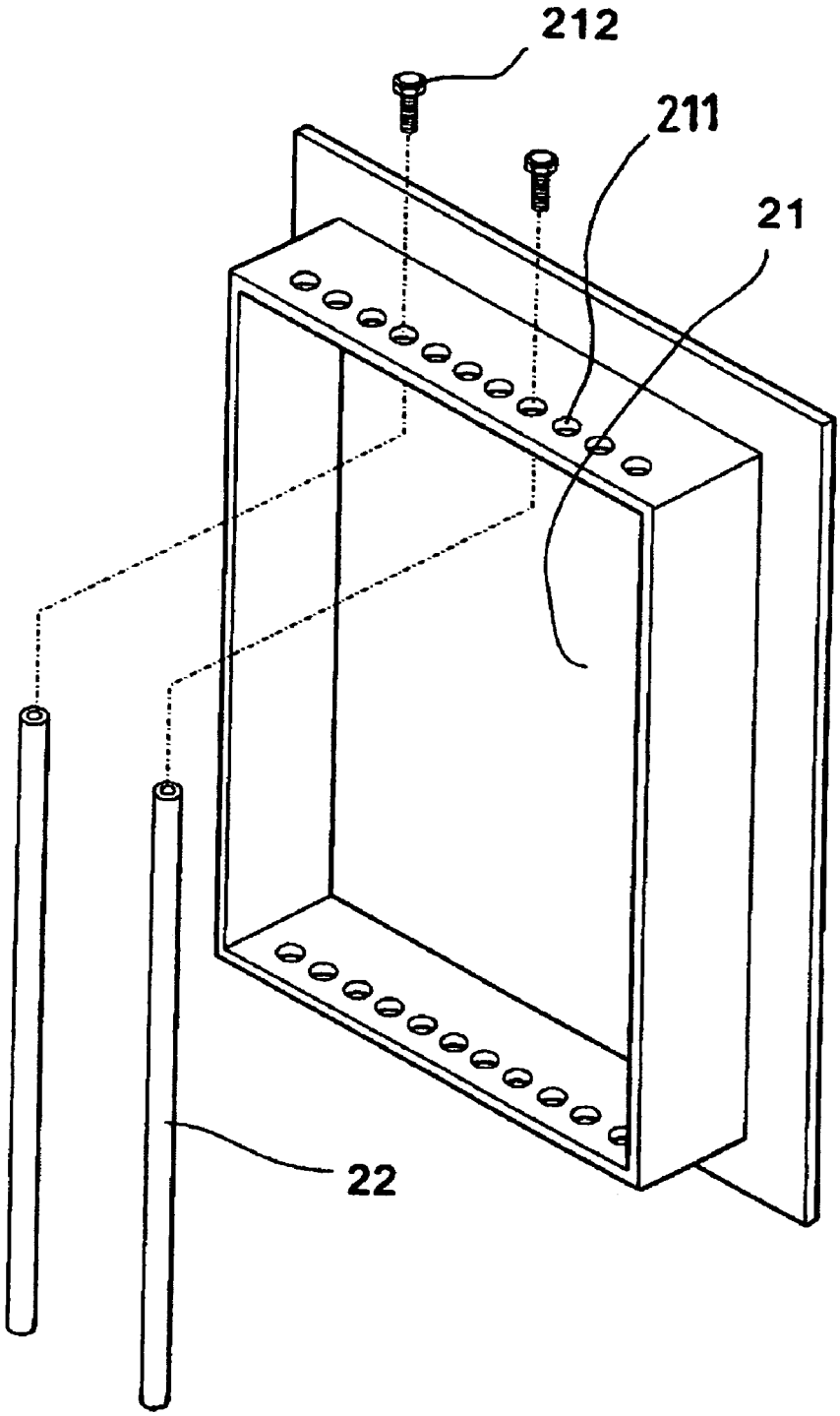
FIG, 8

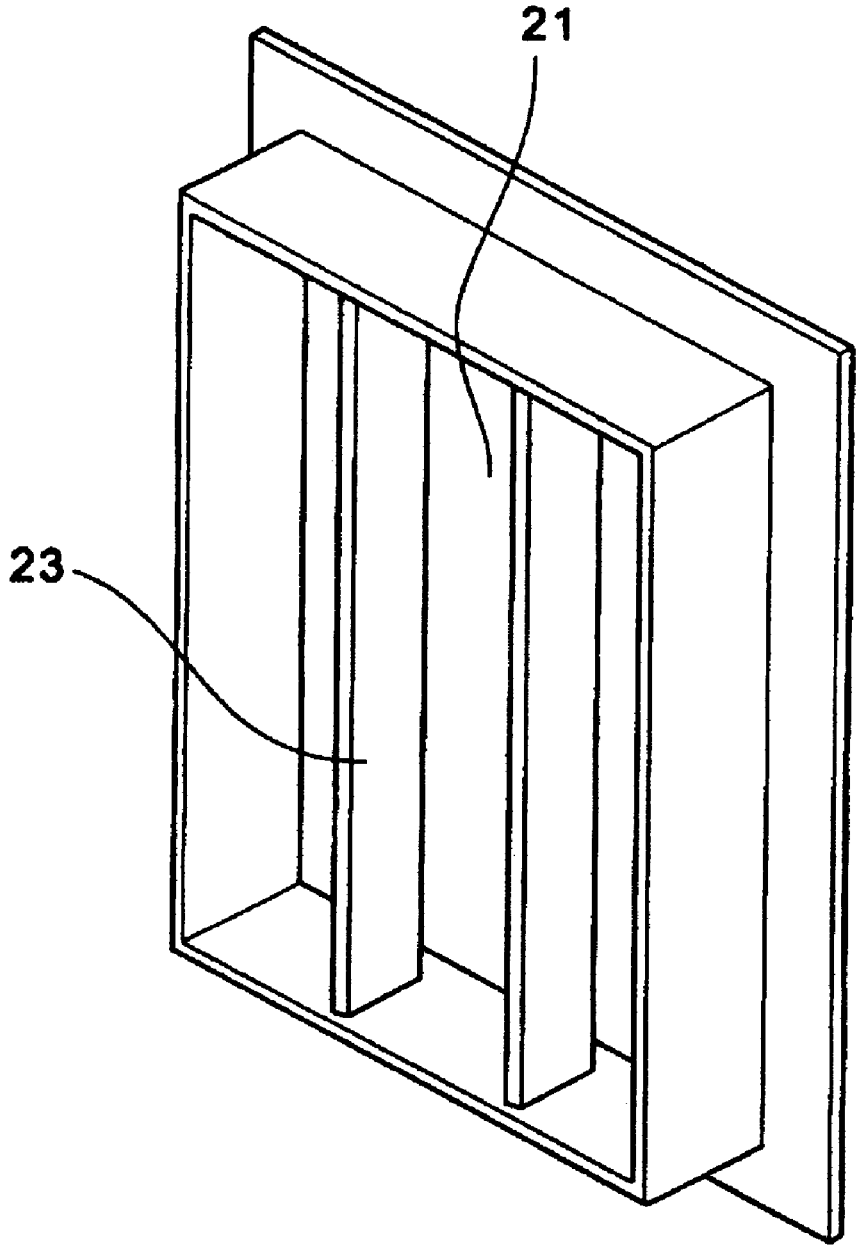
FIG, 9

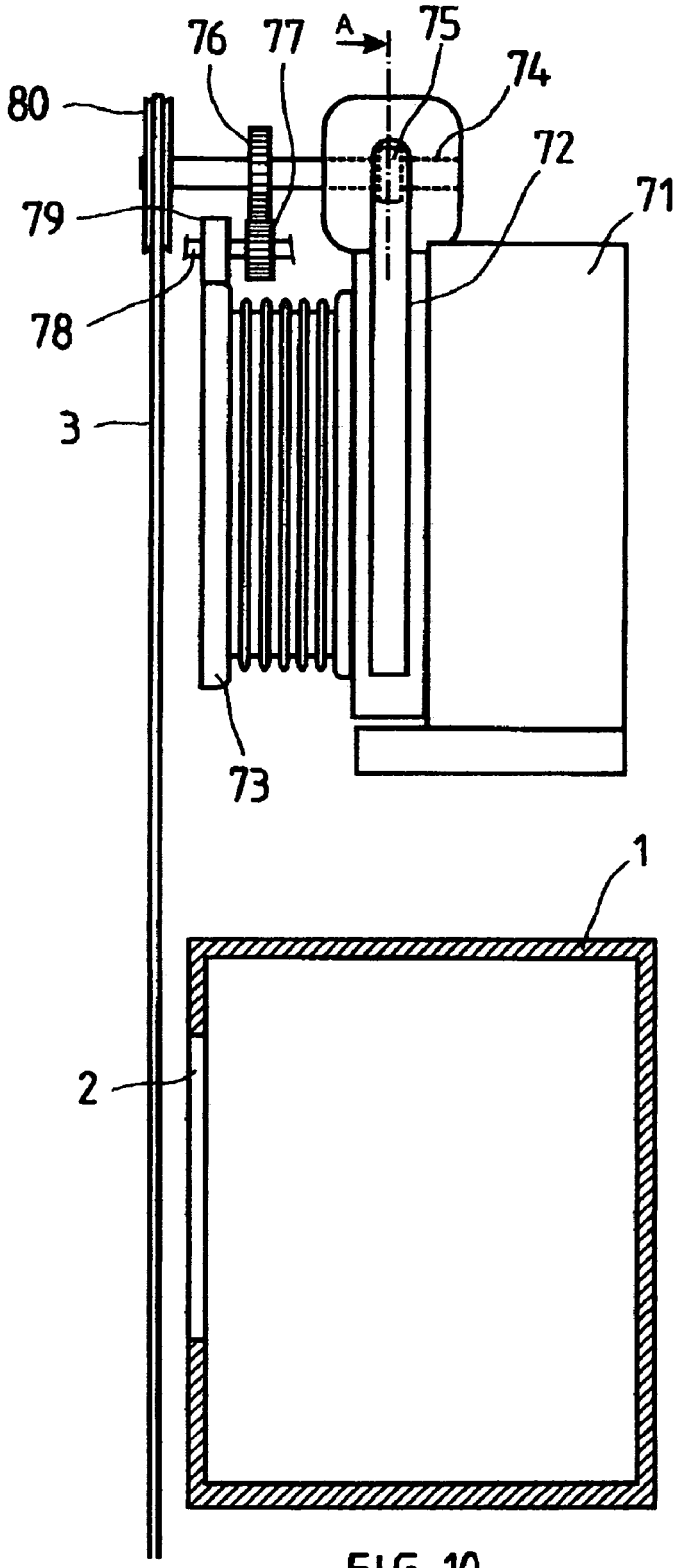
FIG, 10

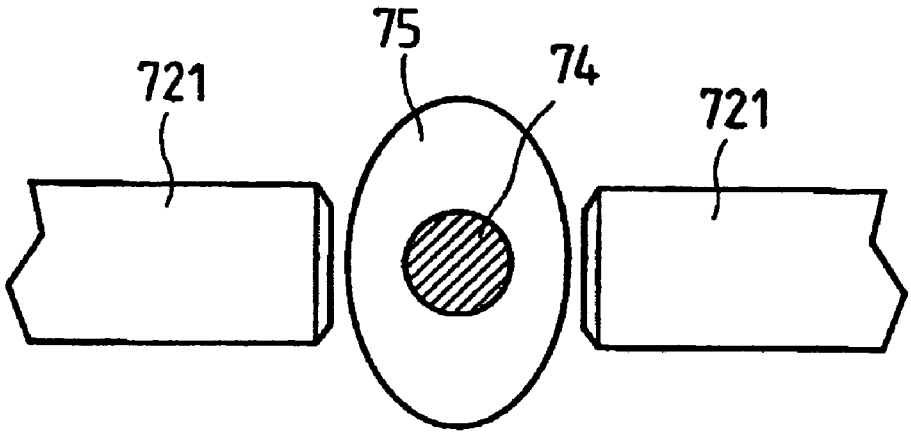
(A)
FIG,11
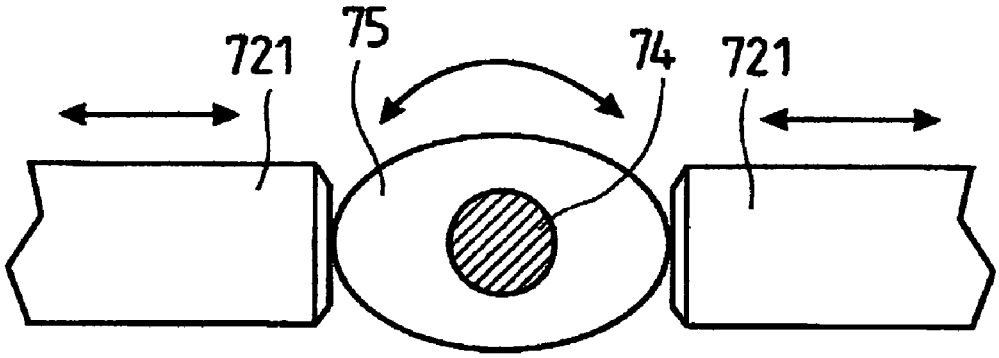
FIG,12

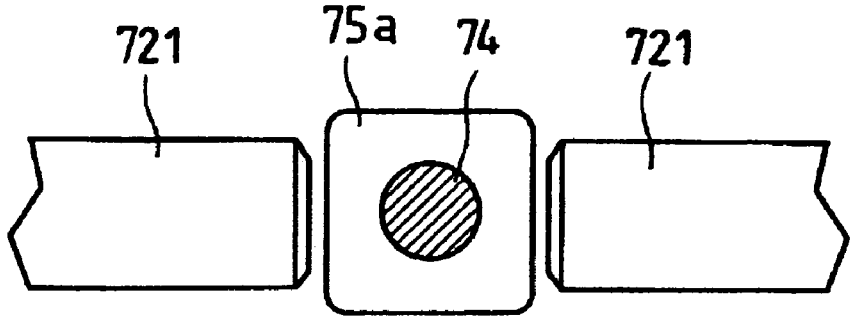
FIG,13
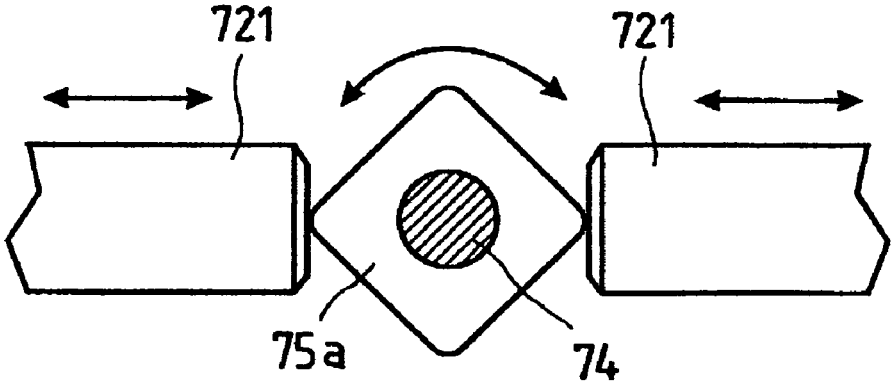
FIG,14

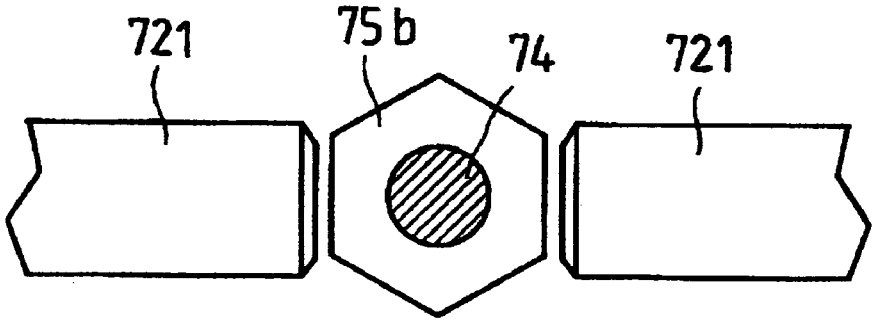
FIG,15
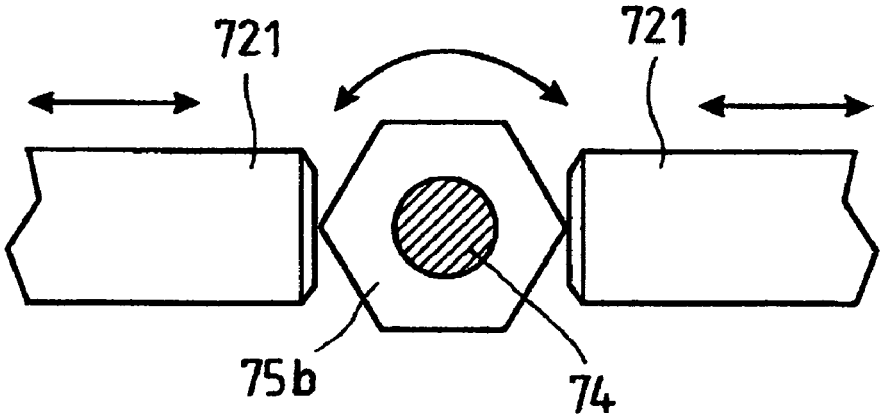
FIG,16

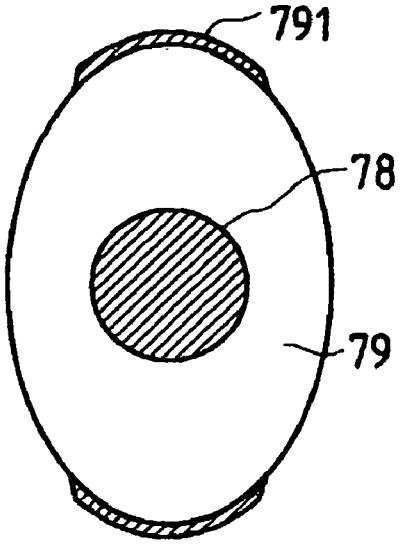
FIG,17
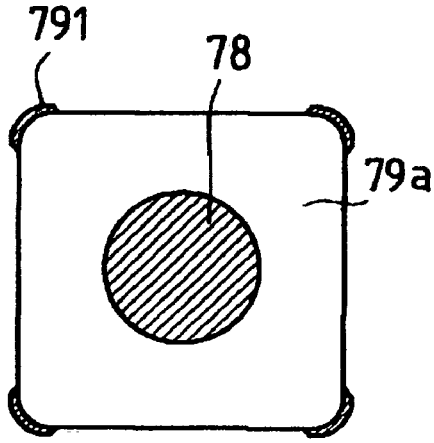
FIG,18
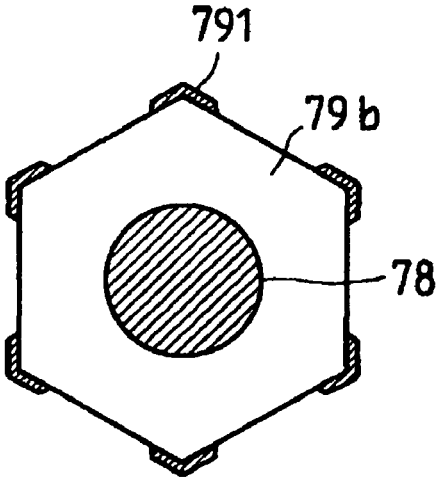
FIG,19

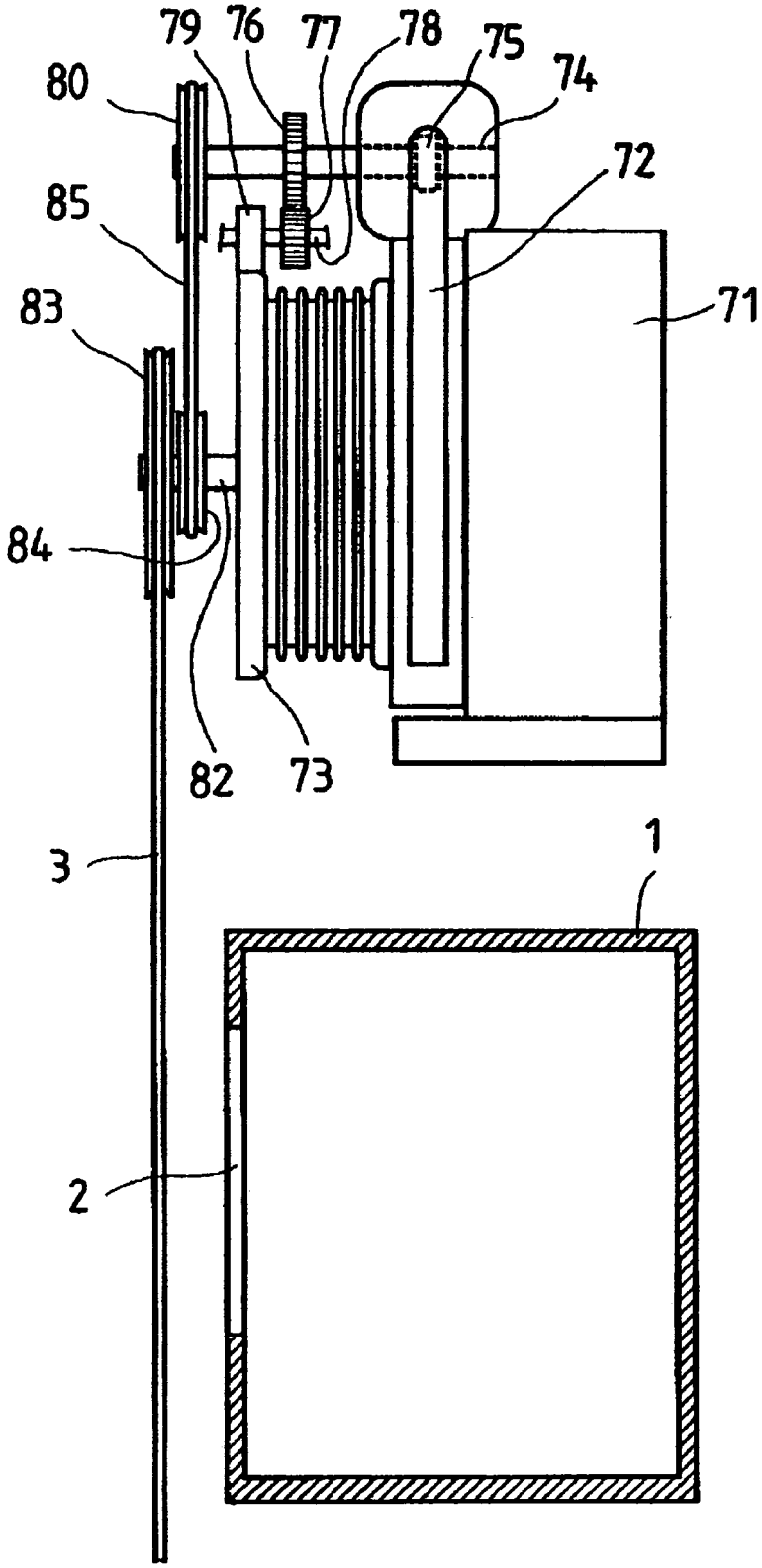
FIG, 20

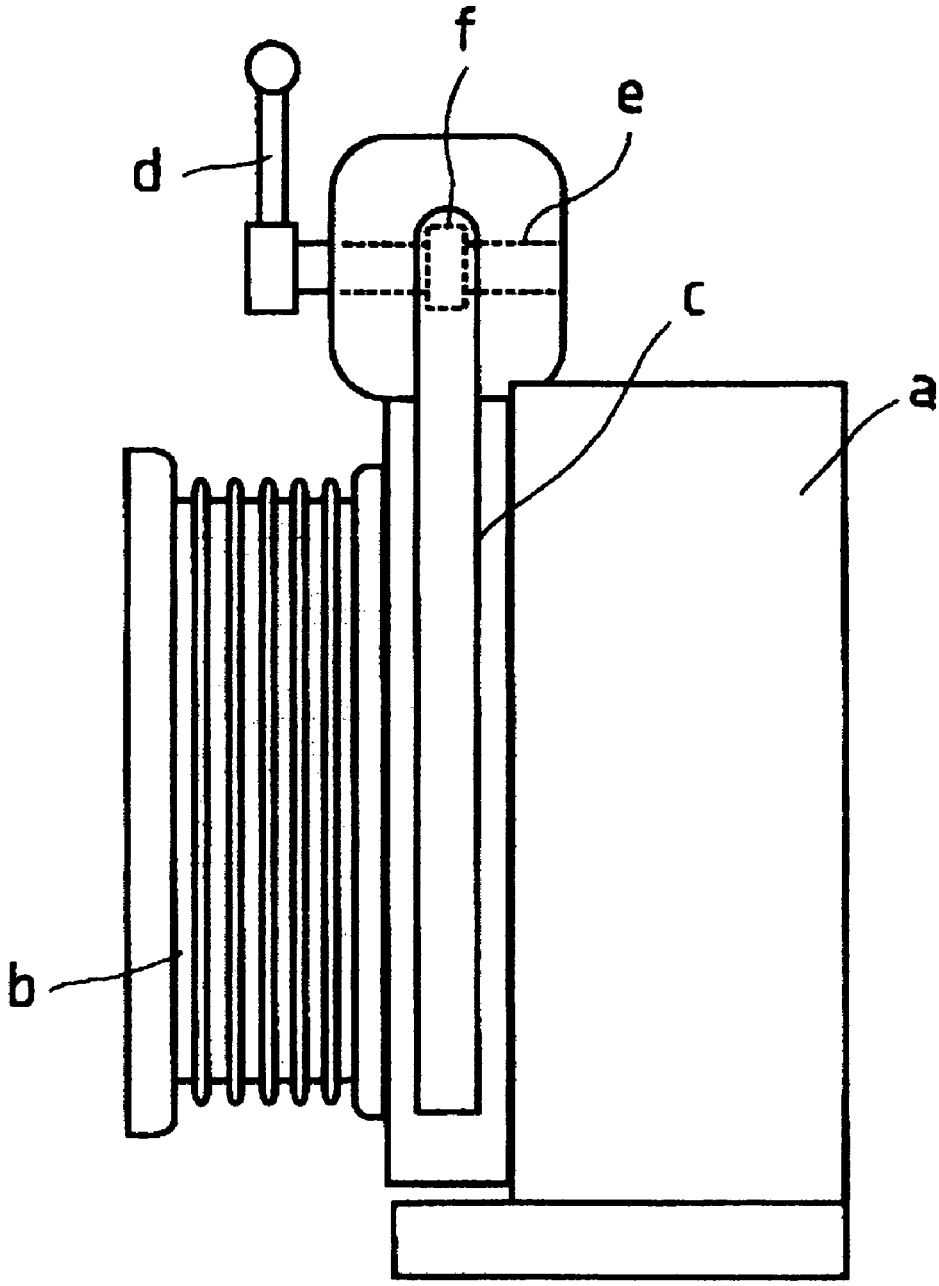
FIG,23
PRIOR ART

ELEVATOR ESCAPE ARRANGEMENT

BACKGROUND OF THE INVENTION

1. Field of Invention

The invention relates to emergency escaping equipment for elevator and more particularly to an elevator car having a window such that in case of emergency a passenger trapped therein may open the window to pull an escape rope to activate an escape mechanism for moving the car to a desired floor and then open the car door to escape safely.

2. Related Art

There is a conventional type of elevator having an alarm button intercom in its car such that passengers trapped in the car due to, for example, power outage or malfunction, may use the intercom to communicate with an outside emergency service. The outside emergency service may then call an elevator mechanic to the rescue.

A drive machine of a conventional elevator is schematically shown in FIG. 23. The drive machine is mounted in a machine room and comprises a motor (a), a drive sheave (b) driven by the motor (a), a plurality of hoist ropes run grooves of the drive sheave (b), and a brake (c) attached between the motor (a) and the drive sheave (b). The brake (c) is adapted to hold the elevator stationary at a floor.

Moreover, the brake (c) is adapted to stop the rotation of the drive sheave (b) in order to prevent the elevator from falling in case of power failure. Also, the car gets stuck between floors. After calling an elevator service provider, an elevator mechanic may rush to the scene to enter the machine room. Thereafter, the mechanic may manually push a lever (d) to turn a shaft (e). And in turn, a detent block (f) is actuated by the shaft (e). Further, the brake (c) is released by the detent block (f) and is kept released. As such, the drive sheave (b) can rotate again. This can move the car to a nearest floor and eventually trapped passengers can safely escape through the car door.

However, the prior art suffered from a couple of disadvantages. For example, it may take one or two hours before the elevator mechanic arrives the scene. This is not desired since it is urgent. In a normal case the car and a counterweight are not balanced. Thus, the car can move until a nearest floor is reached. However, it is possible that the car and the counterweight are balanced when the car is trapped between floors. In this case a mechanic has to manually turn the drive sheave. This is dangerous and the mechanic tends to hurt in the rescue operation. Thus, the need for improvement still exists.

SUMMARY OF THE INVENTION

It is therefore an object of the present invention to provide an emergency arrangement for an elevator including a car, a counterweight, and hoist ropes having one ends connected to a top of the car, comprising a hinged window mounted on a side wall of the car; an escape rope mounted vertically along a hoistway and passed by the window; a switch mounted on a frame of the window; a linking mechanism mounted proximate one side of the door of the car and including a linking rope having the other end extended to the hinge side of the window, and a spring biased bar having one end connected to one end of the linking rope; and a drive assembly mounted in a machine room and including a motor, a drive sheave driven by the motor with the hoist ropes run, a brake attached between the motor and the drive sheave and including two opposite top brake bars, a first shaft mounted on an upper portion of the brake, a detent block fixedly mounted on the first shaft and disposed between the brake bars, a cam-like member engaged with the drive sheave, a pulley assembly mounted at one end of the first shaft distal the detent block with the escape rope run, a first gear mounted around the first shaft between the pulley assembly and the detent block, a second gear meshed with the first gear, and a second shaft passed through the second gear and the cam-like member; whereby in a case of emergency during an upward or a downward travel of the elevator with the car stuck between two floors, the car and the counterweight balanced, and the brake activated, opening the window by a passenger trapped in the car will open the switch to lock the door and pull the linking rope to extend the other end of the bar for blocking the door from being opened forcedly; pulling the escape rope will turn the pulley assembly to turn the first gear and the first shaft with (i) the detent block turned to release the brake by interconnecting the brake bars per a predetermined degree revolution of the first shaft and activate the brake by disconnecting the brake bars per a further predetermined degree revolution of the first shaft, and (ii) the cam-like member turned to turn the drive sheave intermittently, thereby unbalancing the car and the counterweight to move the car to a nearest floor; and leaving the window will close the window automatically and unlock the door by closing the switch and retracting the other end of the bar into the linking mechanism.

In one aspect of the present invention the detent block has an oval section and the predetermined degree revolution of the first shaft is 90 degree.

In another aspect of the present invention the detent block has a square section and the predetermined degree revolution of the first shaft is 45 degree.

In yet another aspect of the present invention the detent block has a hexagonal section and the predetermined degree revolution of the first shaft is 30 degree.

In still another aspect of the present invention the cam-like member has a section of oval and includes two pads at both ends.

In a further aspect of the present invention the cam-like member has a section of square and includes four pads at four corners.

In yet further aspect of the present invention the cam-like member has a section of hexagon and includes six pads at six corners.

In still further aspect of the present invention the window includes one or more guard members.

In still further aspect of the present invention the pulley assembly comprises one or more pulleys.

In still further aspect of the present invention the drive assembly further comprises an auxiliary motor for driving the first shaft, and a backup power supply such that pulling the escape rope will activate the backup power supply to drive the auxiliary motor to move the car.

The above and other objects, features and advantages of the present invention will become apparent from the following detailed description taken with the accompanying drawings.

BRIEF DESCRIPTION OF THE DRAWINGS

FIG. 5 is a side elevation of a first configuration of window closing mechanism;

FIG. 6 is a side elevation of a second configuration of window closing mechanism;

FIG. 7 is a side elevation of a third configuration of window closing mechanism;

FIG. 8 is an exploded perspective view of a first configuration of window safety mechanism;

FIG. 9 is a perspective view of a second configuration of window safety mechanism;

FIG. 10 depicts a remaining part (i.e., a drive machine) of the elevator escape arrangement according to a first preferred embodiment of the present invention and the car in association therewith;

FIG. 11 is a top plan view in part section of two brake bars and a first configuration of detent block disposed there between prior to emergency operation;

FIG. 12 is a view similar to FIG. 11 where the brake bars and the detent block are in operation in case of emergency;

FIG. 13 is a top plan view in part section of the two brake bars and a second configuration of detent block disposed there between prior to emergency operation;

FIG. 14 is a view similar to FIG. 13 where the brake bars and the detent block are in operation in case of emergency;

FIG. 15 is a top plan view in part section of the two brake bars and a third configuration of detent block disposed there between prior to emergency operation;

FIG. 16 is a view similar to FIG. 15 where the brake bars and the detent block are in operation in case of emergency;

FIG. 17 is a sectional view of a first configuration of cam-like member;

FIG. 18 is a sectional view of a second configuration of cam-like member;

FIG. 19 is a sectional view of a third configuration of cam-like member;

FIG. 20 depicts a remaining part (i.e., a drive machine) of an elevator escape arrangement according to a second preferred embodiment of the present invention and the car in association therewith;

FIG. 23 depicts a drive machine of a conventional elevator.

DETAILED DESCRIPTION OF THE INVENTION

Figure 1:
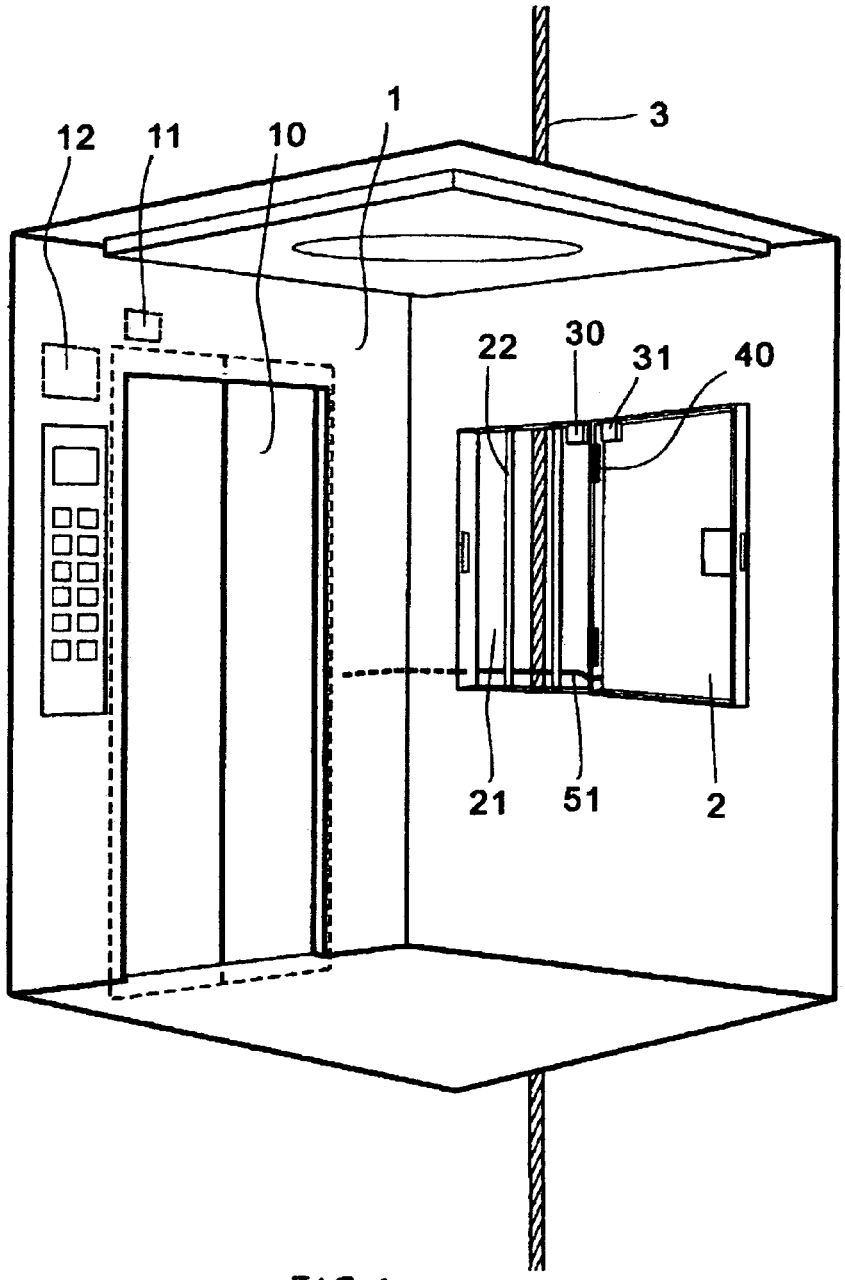
FIG. 1 is a schematic perspective view of an elevator car as a part of an elevator escape arrangement according to the present invention.
Figure 2:
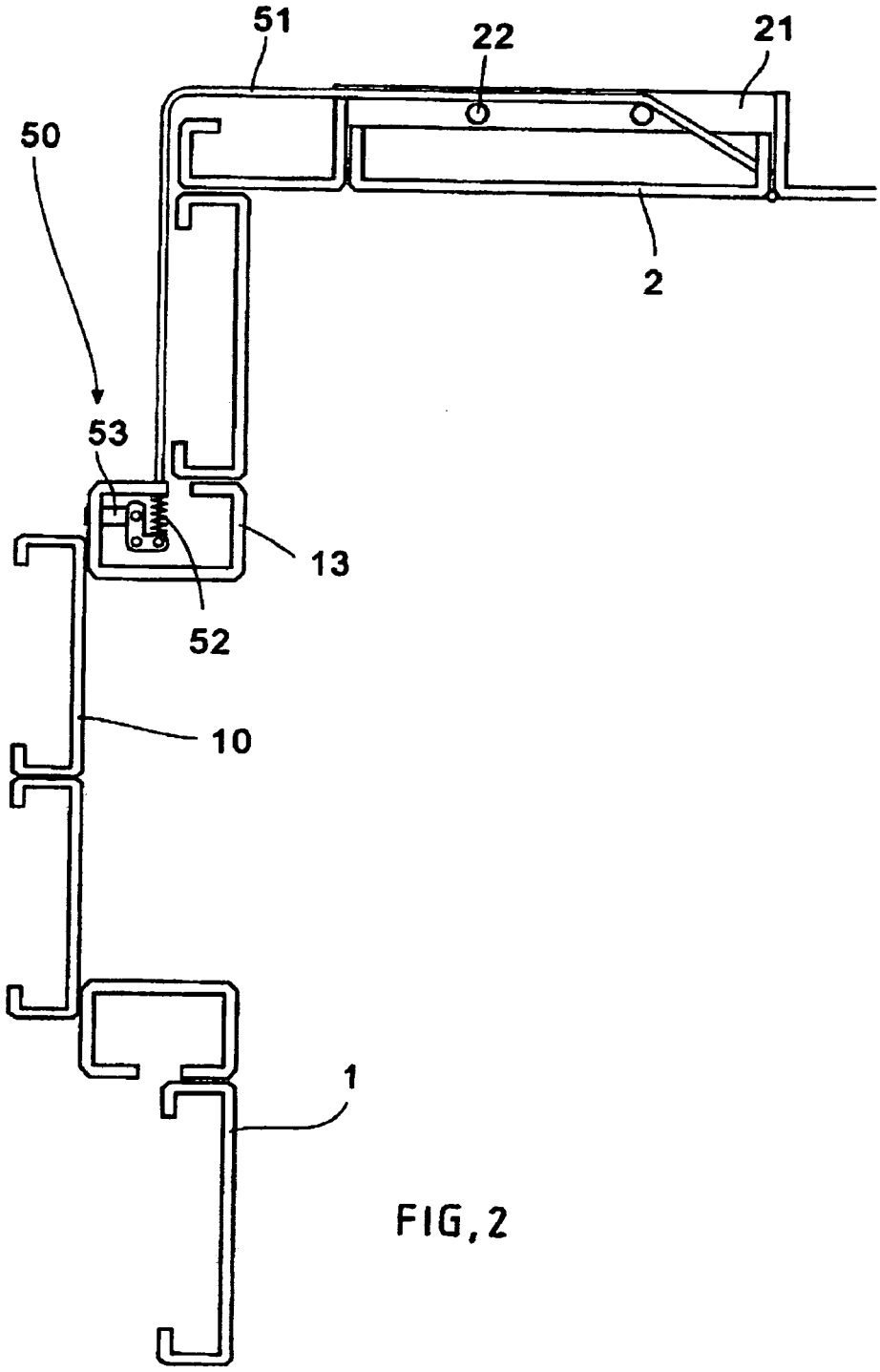
FIG. 2 is a schematic top plan view of a portion of FIG. 1 with the elevator roof removed for discussion clarity.
Figure 3:
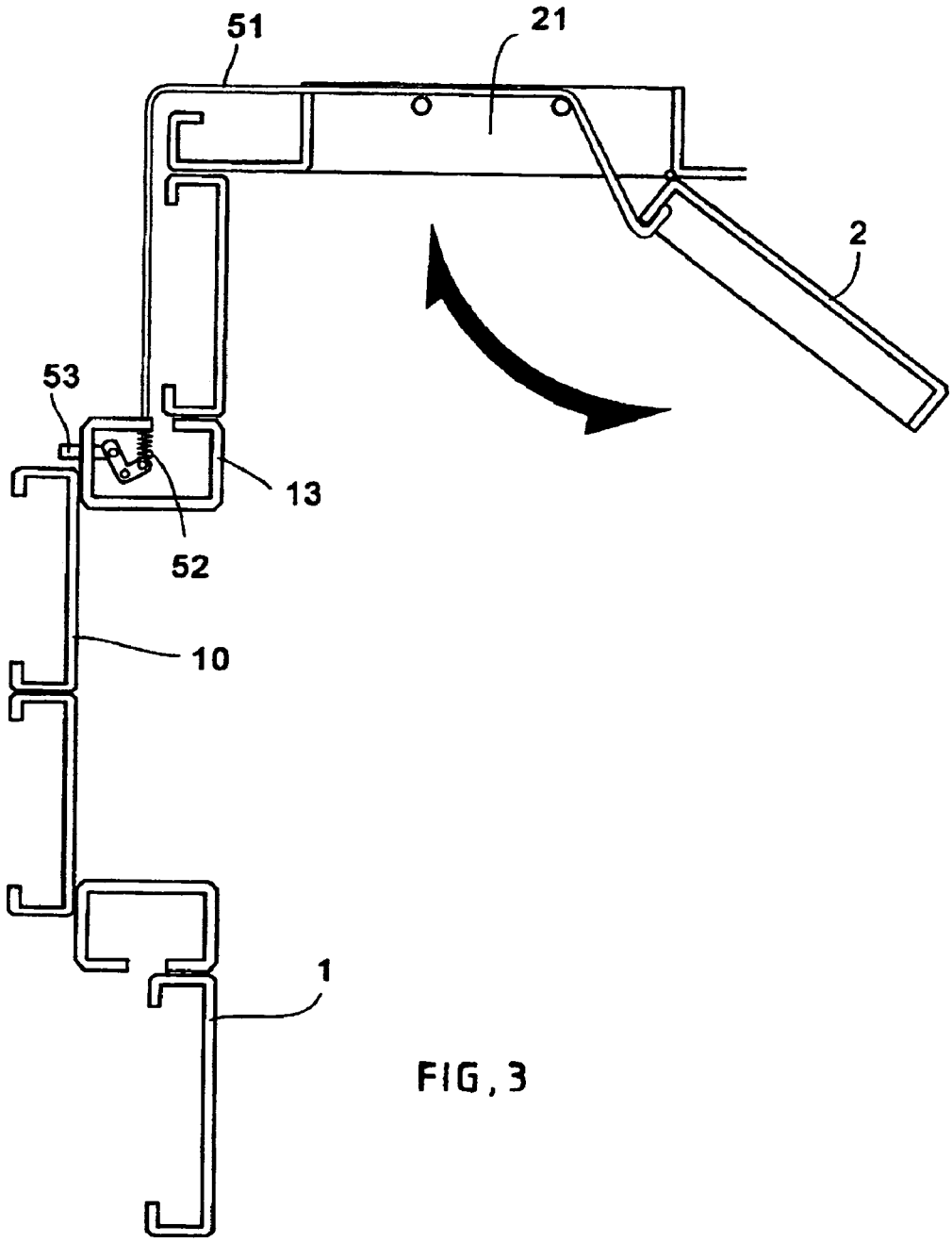
FIG. 3 is a view similar to FIG. 2 for illustrating its operation in case of emergency.
Figure 4:
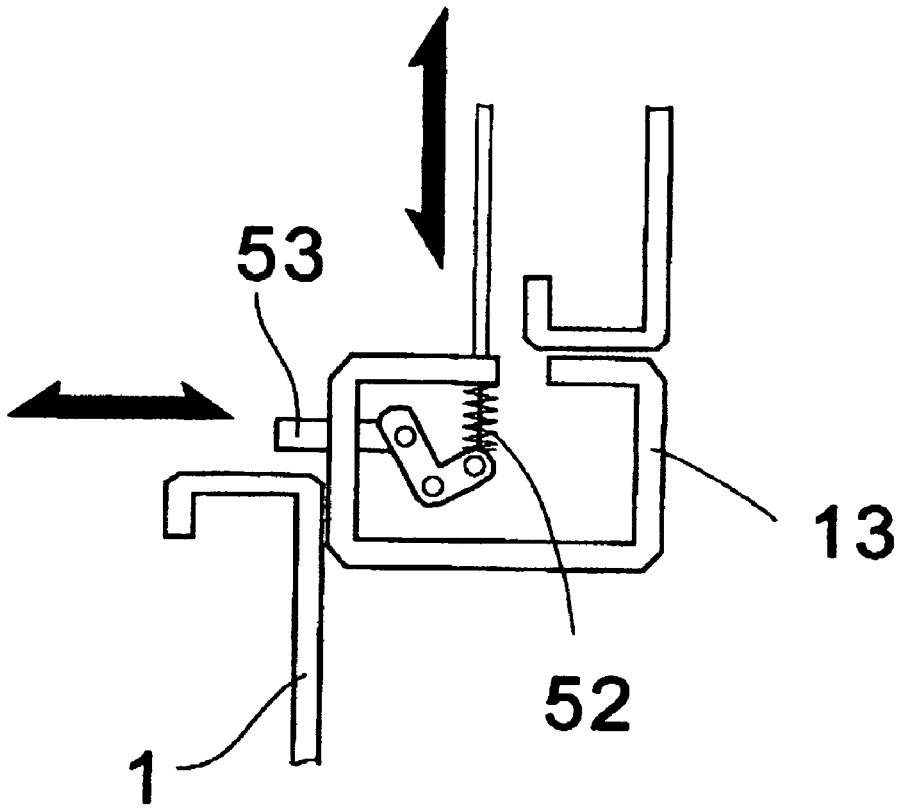
FIG. 4 is an enlarged view of a portion of FIG. 3.

Referring to FIGS. 1 to 12, an elevator car 1 as a part of an elevator escape arrangement in accordance with a first preferred embodiment of the present invention is shown. The car 1 comprises a door 10, a door operator 11 above the door 10 for opening or closing the door 10, and a backup power (e.g., UPS (uninterruptible power supply)) 12 electrically connected to an external power source. A window 2 is provided on a side wall of the car 1. An escape rope 3 is provided vertically along a hoistway. The escape rope 3 passes by the window 2 and is within the reach of an ordinary person when the window 2 is open. The window 2 comprises an opening 21 and a plurality of guard rails 22 having both ends fixedly or releasably secured to top and bottom edges of the window 2 respectively. The provision of the guard rails 22 aims at preventing elevator passengers from falling out of the window 2. A first portion 30 of a switch and a second portion 31 of the switch are provided on the top edge of the window 2. Two spaced window closing mechanisms 40 are provided on a hinge side of the window 2. A linking mechanism 50 is provided in a joining portion 13 of the right side of the door 10 and a front wall of the car 1.

A linking rope 51 is interconnected the linking mechanism 50 and the hinge side of the window 2. A spring 52 is provided at one end of the linking rope 51 in the joining portion 13. A moveable bar 53 is extended from one end of the linking rope 51. In a normal state of the elevator the other end of the bar 53 is retracted to be flush with an outer surface of the joining portion 13 (see FIG. 2). In case of emergency a trapped elevator passenger may open the window 2 to pull the linking rope 51. And in turn, the other end of the bar 53 extends to approach the right side of the door 10 (see FIGS. 3 and 4). This can prevent the door 10 from opening undesirably. Otherwise, the trapped passengers may fall from the door 10 accidentally if the door 10 is open. To the contrary, stopping applying the opening force on the window 2 will automatically retract the linking rope 51 to its original position due to the expansion of the spring 52. As an end, the window 2 is closed.

Referring to FIG. 5 specifically, a first configuration of the window closing mechanism is shown. The window closing mechanism is similar to a shutter hinge and comprises a hinge bolt (shown in dash line but not numbered), a first hinge piece 60 having an inclined face 62, a second hinge piece 61 having an inclined face mated with the inclined face 62 of the first hinge piece 60. Referring to FIG. 6 specifically, a second configuration of the window closing mechanism is shown. The window closing mechanism is similar to a spring hinge and comprises a hinge bolt (shown in dash line but not numbered), a first hinge piece 63, a second hinge piece 64, and an expansion spring 65 having one end 651 secured to the first hinge piece 63 and the other end 652 secured to the second hinge piece 64. Referring to FIG. 7 specifically, a third configuration of the window closing mechanism is shown. The window closing mechanism is another type of spring hinge and comprises a hinge bolt (shown in dash line but not numbered), a first hinge piece 66, a second hinge piece 67, and a spring 68 having both ends 681 secured to the first hinge piece 66 and an intermediate portion urged against the second hinge piece 67. Any of the above window closing mechanisms is adapted to automatically close the window 2 in response to removing the window opening force.

Referring to FIG. 8 specifically, a first configuration of the window safety mechanism is shown. The window safety mechanism comprises a plurality of vertical guard rails 22 each having either end fitted in one of a plurality of holes 211 formed on a top or a bottom of a window frame (not numbered) with the opening 21 confined therein. Further, one of a plurality of threaded fasteners (e.g., bolt) 212 is driven into the hole 211 and either end of the guard rail 22 to secure the guard rail 22 to the window frame.

Referring to FIG. 9 specifically, a second configuration of the window safety mechanism is shown. The window safety mechanism comprises two vertical guard plate 23 each having either end fixedly secured to a top or a bottom of a window frame (not numbered) with the opening 21 confined therein by soldering.

Referring to FIGS. 10, 11, and 12 specifically, a remaining part (i.e., a drive machine) of the elevator escape arrangement is shown. The drive machine is mounted in a machine room (not shown) and comprises a motor 71, a drive sheave 73 driven by the motor 71, a brake 72 attached between the motor 71 and the drive sheave 73 and including two opposite brake bars 721 at a top, a shaft 74 provided on an upper portion of the brake 72, a detent block 75 fixedly mounted on the shaft 74 and disposed between the brake bars 721, a cam-like member 79 engaged with the drive sheave 73, a main pulley 80 provided at one end of the shaft 74 distal the detent block 75 with a top of the escape rope 3 run, a first gear 76 provided around the shaft 74 between the main pulley 80 and the detent block 75, a second gear 77 meshed with the first gear 76, and a shaft 78 passed through the second gear 77 and the cam-like member 79.

Should an emergency situation (e.g., power outage or malfunction) arises during an upward or downward travel of the elevator with the car 1 stuck between two floors, the car 1 and a counterweight (not shown) balanced (i.e., the car 1 is motionless), and the brake 72 activated, a passenger trapped in the car 1 may immediately open the window 2. The first portion 30 of the switch is thus disengaged with the second portion 31 thereof (i.e., the switch is open). The door operator 11 is deactivated due to the opening of the switch. A normal opening of the door 10 is thus made impossible. As stated above, the linking rope 51 is also pulled when the window 2 is open. And in turn, the other end of the bar 53 extends to approach the right side of the door 10. This can prevent the door 10 from opening undesirably. The trapped passenger may further pull the escape rope 3 to turn the main pulley 80. Both the first gear 76 and the shaft 74 turn accordingly. In one section, the detent block 75 turns to interconnect the brake bars 721 per 90 degree revolution of the shaft 74 (i.e., the brake 72 is released as shown in FIG. 12) and disconnect one brake bar 721 from the other brake bar 721 per further 90 degree revolution of the shaft 74 (i.e., the brake 72 is activated as shown in FIG. 11). That is, the brake 72 is released and activated alternately. In the other section, the cam-like member 79 turns as a result of rotational motion transmitted from the first gear 76 to itself via the second gear 77. And in turn, the drive sheave 73 turns intermittently due to the nature of the cam-like member 79 and as a result of cooperation with the brake 72. The car 1 and the counterweight are thus not balanced due to the pulling of the escape rope 3. As a result, in one example, the car 1 is lowered to a nearest floor and lines up therewith. At this time, the trapped passenger may leave the window 2 and the window 2 then automatically closes. Further, the door 10 is no longer locked by the linking mechanism 50. Thus, the trapped passengers may open the door 10 to escape safely.

Referring to FIGS. 11 and 12 again, a first configuration of the detent block 75 is shown. The detent block 75 has an oval section and is fixedly mounted on the shaft 74 and disposed between the brake bars 721. As stated above, turning the detent block 75 will interconnect the brake bars 721 per 90 degree revolution of the shaft 74 by engaging its both ends with opposite ends of the brake bars 721 (i.e., the brake 72 is released as shown in FIG. 12) and disconnect one brake bar 721 from the other brake bar 721 per further 90 degree revolution of the shaft 74 (i.e., the brake 72 is activated as shown in FIG. 11).

Referring to FIGS. 13 and 14, a second configuration of the detent block 75*a* is shown. The detent block 75*a* has a square section and is fixedly mounted on the shaft 74 and disposed between the brake bars 721. Similar to the first configuration of the detent block 75, turning the detent block 75*a* will interconnect the brake bars 721 per 45 degree revolution of the shaft 74 by engaging its any two opposite corners with opposite ends of the brake bars 721 (i.e., the brake 72 is released as shown in FIG. 14) and disconnect one brake bar 721 from the other brake bar 721 per further 45 degree revolution of the shaft 74 (i.e., the brake 72 is activated as shown in FIG. 13).

Referring to FIGS. 15 and 16, a third configuration of the detent block 75*b* is shown. The detent block 75*b* has a hexagonal section and is fixedly mounted on the shaft 74 and disposed between the brake bars 721. Similar to the first configuration of the detent block 75, turning the detent block 75*b* will interconnect the brake bars 721 per 30 degree revolution of the shaft 74 by engaging its any two opposite corners with opposite ends of the brake bars 721 (i.e., the brake 72 is released as shown in FIG. 16) and disconnect one brake bar 721 from the other brake bar 721 per further 30 degree revolution of the shaft 74 (i.e., the brake 72 is activated as shown in FIG. 15).

Referring to FIGS. 17, 18, and 19, first, second, and third configurations of the cam-like members 79, 79*a*, and 79*b* are shown respectively. The cam-like member 79 has a section of oval and two pads 791 at both ends. The cam-like member 79*a* has a section of square and four pads 791 at four corners. The cam-like member 79*b* has a section of hexagon and six pads 791 at six corners. The provision of the pads 791 aims at buffering the contact of the rotating cam-like member 79, 79*a*, or 79*b* and the drive sheave 73.

It is found that the cam-like member 79 is constructed substantially the same as the detent block 75 except the pads 791 thereof. Further, the cam-like member 79 and the detent block 75 are in phase in their rotating operations. Furthermore, in a normal travel of the elevator the brake 72 is disengaged with the detent block 75 and the drive sheave 73 is disengaged with the cam-like member 79 respectively.

Referring to FIG. 20, a remaining part (i.e., a drive machine) of an elevator escape arrangement according to a second preferred embodiment of the present invention and the car 1 in association therewith are shown. The second embodiment is identical to the first embodiment, except that a shaft 82 is extended from a position aligned with and proximate a center of the drive sheave 73, a first intermediate pulley 83 is provided on an open end of the shaft 82, and a second intermediate pulley 84 having a diameter smaller than that of the first intermediate pulley 83 is provided on the shaft 82 between the first intermediate pulley 83 and the drive sheave 73. Top of the escape rope 3 runs the first intermediate pulley 83. A rope 85 is trained around the main pulley 80 and the second intermediate pulley 84. The shaft 82 is disengaged with the rotating shaft of the drive sheave 73 which is driven by the motor 71 in a normal operation of the elevator. In a case of emergency, pulling the escape rope 3 will turn the first intermediate pulley 83 and thus the second intermediate pulley 84. As a result, the main pulley 80 turns. The second embodiment is advantageous for saving labor because the first intermediate pulley 83 has a relatively large diameter.

Figure 21:
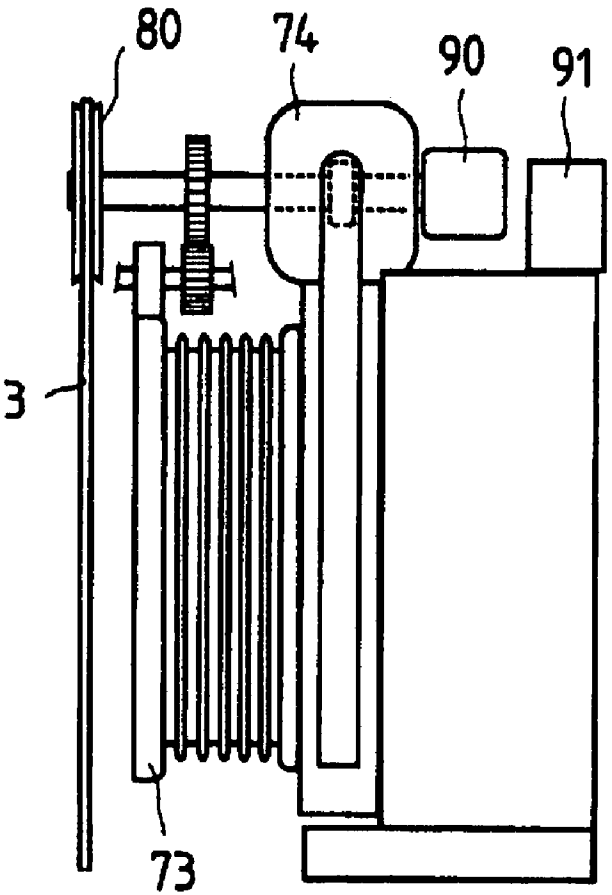
FIG. 21 depicts a remaining part (i.e., a drive machine) of an elevator escape arrangement according to a third preferred embodiment of the present invention.

Referring to FIG. 21, a remaining part (i.e., a drive machine) of an elevator escape arrangement according to a third preferred embodiment of the present invention is shown. The third embodiment is identical to the first embodiment, except that an auxiliary motor 90 is provided for driving the shaft 74, and a second backup power (e.g., UPS (uninterruptible power supply)) 91 electrically connected to an external power source. The auxiliary motor 90 is powered by the second backup power 91. In a case of emergency, pulling the escape rope 3 by one trapped passenger will activate the auxiliary motor 90 to move the car 1 until trapped passengers can escape safely. The third embodiment can further save labor in case of emergency.

Figure 22:
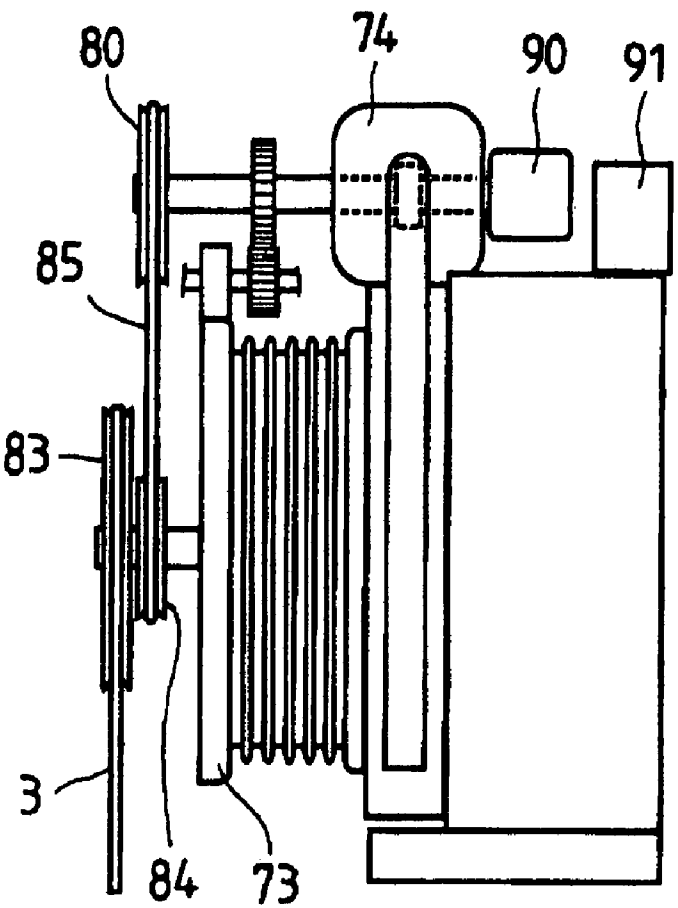
FIG. 22 depicts a remaining part (i.e., a drive machine) of an elevator escape arrangement according to a fourth preferred embodiment of the present invention.

Referring to FIG. 22, a remaining part (i.e., a drive machine) of an elevator escape arrangement according to a fourth preferred embodiment of the present invention is shown. The fourth embodiment is a combination of the second and third embodiments. The fourth embodiment can save labor more than the third embodiment in case of emergency.

It is to be understood that the present invention is by no means limited only to the particular constructions herein disclosed and shown in the drawings, but also comprises any modifications or equivalents within the scope of the claims.

What is claimed is:

1. An emergency arrangement for an elevator including a car, a counterweight, and hoist ropes having one end connected to a top of the car, comprising:

a hinged window provided on a side wall of the car;

an escape rope provided vertically along a hoistway and passed by the window;

a switch provided on a frame of the window;

a linking mechanism provided proximate one side of the door of the car and including a linking rope having the other end extended to the hinge side of the window, and a spring biased bar having one end connected to one end of the linking rope; and a drive assembly mounted in a machine room and including a motor, a drive sheave driven by the motor with the hoist ropes run, a brake attached between the motor and the drive sheave and including two opposite top brake bars, a first shaft provided on an upper portion of the brake, a detent block fixedly mounted on the first shaft and disposed between the brake bars, a cam member engaged with the drive sheave, a pulley assembly provided at one end of the first shaft distal the detent block with the escape rope run, a first gear provided around the first shaft between the pulley assembly and the detent block, a second gear meshed with the first gear, and a second shaft passed through the second gear and the cam member;

whereby in a case of emergency during an upward or a downward travel of the elevator with the car stuck between two floors, the car and the counterweight balanced, and the brake activated, opening the window by a passenger trapped in the car will open the switch to lock the door and pull the linking rope to extend the other end of the bar for blocking the door from being opened forcedly; pulling the escape rope will turn the pulley assembly to turn the first gear and the first shaft with (i) the detent block turned to release the brake by interconnecting the brake bars per a predetermined degree revolution of the first shaft and activate the brake by disconnecting the brake bars per a further predetermined degree revolution of the first shaft, and (ii) the cam member turned to turn the drive sheave intermittently, thereby unbalancing the car and the counterweight to move the car to a nearest floor; and leaving the window will close the window automatically and unlock the door by closing the switch and retracting the other end of the bar into the linking mechanism.

2. The emergency arrangement of claim 1, wherein the detent block has an oval section.

3. The emergency arrangement of claim 2, wherein the predetermined degree revolution of the first shaft is 90 degree.

4. The emergency arrangement of claim 1, wherein the detent block has a square section.

5. The emergency arrangement of claim 4, wherein the predetermined degree revolution of the first shaft is 45 degree.

6. The emergency arrangement of claim 1, wherein the detent block has a hexagonal section.

7. The emergency arrangement of claim 6, wherein the predetermined degree revolution of the first shaft is 30 degree.

8. The emergency arrangement of claim 1, wherein the cam member has a section of oval and includes two pads at both ends.

9. The emergency arrangement of claim 1, wherein the cam member has a section of square and includes four pads at four corners.

10. The emergency arrangement of claim 1, wherein the cam member has a section of hexagon and includes six pads at six corners.

11. The emergency arrangement of claim 1, wherein the window includes one or more guard members.

12. The emergency arrangement of claim 1, wherein the pulley assembly comprises one or more pulleys.

13. The emergency arrangement of claim 1, wherein the drive assembly further comprises an auxiliary motor for driving the first shaft, and a backup power supply such that pulling the escape rope will activate the backup power supply to drive the auxiliary motor to move the car.

* * * * *